US005639012A

United States Patent [19]

Urech

[11] Patent Number: 5,639,012

[45] Date of Patent: Jun. 17, 1997

[54] PROCESS AND DEVICE FOR THE POSTTREATMENT OF WELDED COMPOUND PANELS

[75] Inventor: Werner Urech, Kaiserstuhl, Switzerland

[73] Assignee: Elpatronic AG, Zug, Switzerland

[21] Appl. No.: 443,589

[22] Filed: May 17, 1995

[30] Foreign Application Priority Data

Jun. 23, 1994 [CH] Switzerland ..... 2001/94

[51] Int. Cl.[6] ..... B23K 31/02; B23K 37/00

[52] U.S. Cl. ..... 228/200; 228/201; 228/222; 228/46

[58] Field of Search ..... 228/200, 201, 228/222, 46, 199

[56] References Cited

U.S. PATENT DOCUMENTS

| | | | |
|---|---|---|---|
| 1,363,326 | 12/1920 | Kritz | 228/46 |
| 3,482,296 | 12/1969 | Sampatacos | 228/200 |
| 3,513,520 | 5/1970 | Vandervell | 228/200 |
| 3,756,489 | 9/1973 | Chartet | 228/46 |
| 3,855,014 | 12/1974 | DeVries et al. | 148/28 |

FOREIGN PATENT DOCUMENTS

| | | | |
|---|---|---|---|
| 0262363 | 4/1988 | European Pat. Off. . | |
| 2138243 | 5/1973 | France . | |
| 1536983 | 5/1973 | France . | |
| 2942868 | 2/1981 | Germany . | |
| 3-66491A | 3/1991 | Japan | 228/200 |
| 536920 | 12/1976 | U.S.S.R. | 228/200 |
| 8605210 | 9/1986 | WIPO . | |

OTHER PUBLICATIONS

J.B. Phaneuf, "System for Cleaning Contact Fingers on Printed Wiring Boards," *Western Electric Tech. Dig.*, No. 54, Apr. 1979, pp. 23–24.

"Fluxless Brazing of Large Structural Panels," *NASA Tech Briefs*, Spring 1981, pp. 96–97.

*Primary Examiner*—P. Austin Bradley
*Assistant Examiner*—Jeffrey T. Knapp
*Attorney, Agent, or Firm*—McCormick, Paulding & Huber

[57] ABSTRACT

In a compound panel welding line, the compound panels discharged from a welding machine are cooled by means of a cooling unit. In the cooling unit, the welded seam is treated with a cooling fluid, in particular a rust-preventative oil. This allows the panels to be cooled and oiled within a very short time and over a very short distance, thus substantially reducing the overall length of a welding line, and greatly facilitating the handling of the compound panels.

21 Claims, 3 Drawing Sheets

PROCESS AND DEVICE FOR THE POSTTREATMENT OF WELDED COMPOUND PANELS

BACKGROUND OF THE INVENTION

The invention relates to a process for the posttreatment of welded compound panels. The invention also relates to a device for carrying out the process.

Especially for the motor vehicle industry, but also for other applications, sheet-metal blanks (so-called "compound panels" or "tailored blanks") are increasingly being produced which are assembled from a number of flat sheet-metal parts of equal or unequal thickness e.g. by roller seam welding or laser welding. These blanks are formed into structural components, such as car body parts, which possess precisely defined characteristics due to their having portions of dissimilar thickness or material properties. Production of these blanks is extensively mechanized and is performed in large high-capacity production lines comprising automatic welding machines, conveyor systems and storage stations.

After welding, the weld margins are treated with oil to prevent rust and, if need be, are also brush treated. To prevent the oil from vaporizing, or even burning, it is not applied until the welded seam has cooled to a temperature of 100° C. or below. As the sheets are heated to around melting point (in the region of 1500° C.) in the welding process and are still at a temperature of 1000°–1200° C. after leaving the welding rollers, a minimum cooling time of approx. 3 to 5 minutes must be allowed for in the layout of the welding line, that is to say, a buffer line of the requisite length, or even intermediate storage, must be provided between the welding station and the oiling station; the result is extended and complex production lines.

It is therefore the object of the invention to provide a process for the posttreatment of compound panels which does not possess these drawbacks, and which produces treated panels quickly and without taking up a lot of space.

This object is attained by the features of the present invention.

SUMMARY OF THE INVENTION

By cooling the compound panel with a fluid, preferably with rust-preventative oil, the cooling time can be reduced to a fraction of that which has been necessary hitherto. Extended buffer lines and intermediate storage prior to oiling are therefore unnecessary.

The fluid, which may be a rust-preventative oil or an oil/water emulsion, is preferably applied when the weld is at a temperature which is 1.5 to 3 times the vaporization temperature of the fluid. The temperature of the weld is preferably around 150° to 300° C. when the fluid is applied. Cooling to this temperature after welding is relatively rapid, depending on the sheet-metal combination.

In other words, the sheets are conveyed out of the welding machine and the weld margin is immediately treated—preferably on both sides of the sheet, or alternatively on one side only—with sufficient oil to cause the weld and the area immediately around it to cool rapidly to 100° C. or below. Excess oil is removed by wiping and/or by suction. The resulting vapour, and any slight fumes which may be given off, are extracted. Since the quenching temperature is relatively low, there is no undesired hardening of the weld. The generally low carbon content of the sheets also prevents hardening. On leaving the oiling station, the weld is in an oiled condition, and vaporization has ceased to occur.

Brushing may take place after and/or during the cooling with the fluid. This consists of cleaning with a relatively soft brush (with bristles of e.g. nylon, brass or bronze). Owing to the large quantity of fluid applied for cooling, the fluid itself produces a thorough cleaning action, so that it may even be possible to dispense with brushing altogether.

The weld is preferably smoothed with a smoothing roller before the fluid is applied. This roller may be cooled (e.g. by water cooling), which accelerates the cooling of the weld to fluid application temperature.

In addition, before the fluid is applied, a rough or abrasive cleaning of the welded seam may be performed, e.g. with a wire brush, to remove weld spatter.

BRIEF DESCRIPTION OF THE DRAWINGS

Embodiments of the invention will now be described in detail by way of example, with reference to the drawings, in which.

DESCRIPTION OF THE PREFERRED EMBODIMENTS

Figure 1:
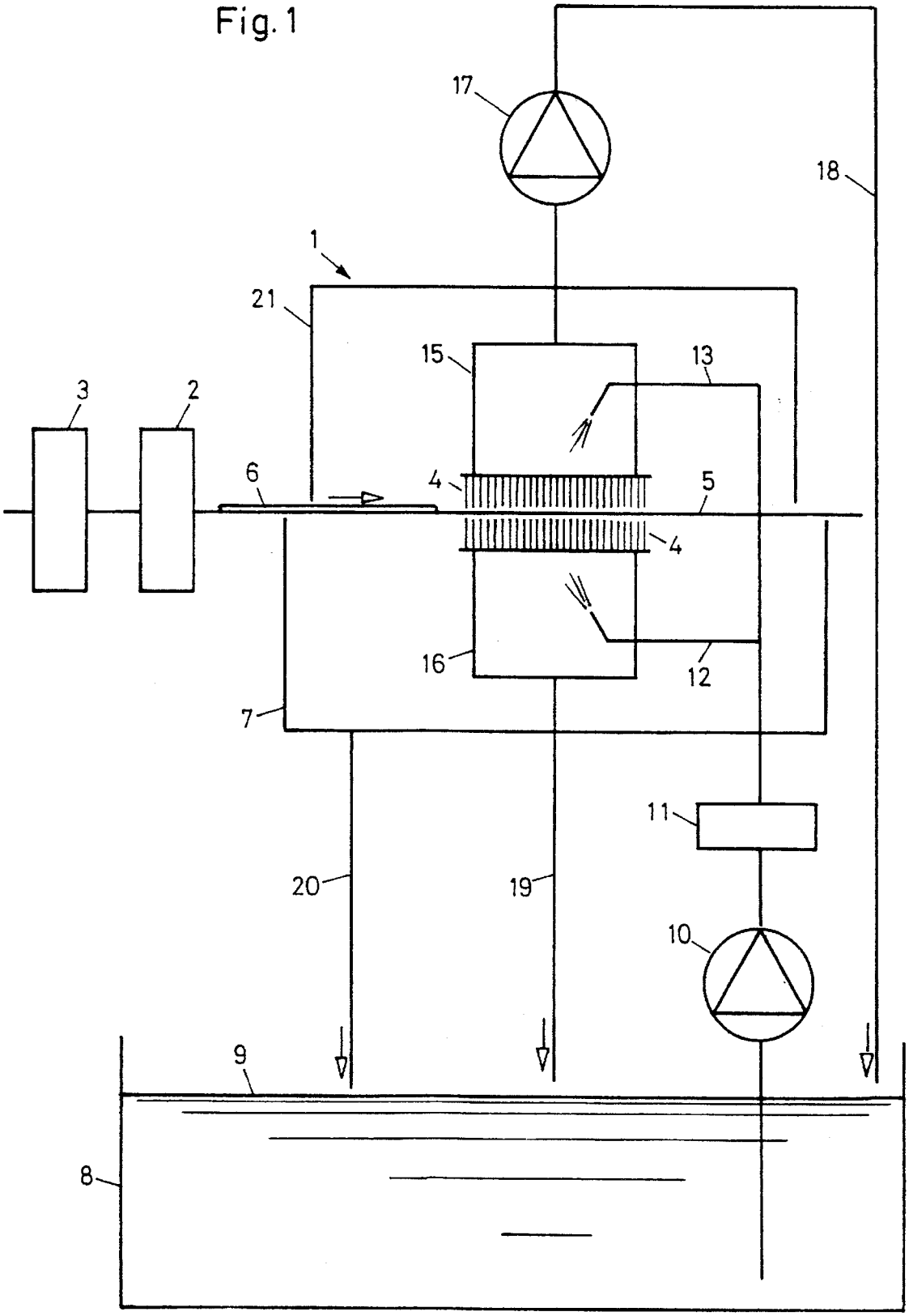
FIG. 1 shows in highly schematic form a vertical cross-section through an embodiment of a device for carrying out the process.

FIG. 1 shows, in highly schematic form, a posttreatment device 1 for a welded sheet or compound panel 6, which is also referred to a tailored blank. This panel 6 has first been welded in a welding machine 3 which is illustrated merely as a block. This welding machine 3 may be e.g. a roller seam welding unit or a laser welding unit. A smoothing and brushing unit 2 may be located after the welding machine 3. In FIG. 1 this unit is likewise illustrated merely as a box 2, as, like the welding machine, it is based on a known principle. In this unit 2 the welded seam is smoothed by means of a roller, and coarse contamination of the welded seam, such as spatter for example, is removed with a wire brush. The welded compound panel 6 then passes on a conveyor 5 (which is not illustrated in detail) into the cooling device 1. The panel 6 can be within the cooling device 1 approximately 20 seconds after welding, as the temperature of the weld will by then have fallen to approx. 200° C. If a smoothing and brushing unit 2 is provided, the time to insertion into the cooling unit 1 may even be shorter. It is possible to use e.g. a water-cooled smoothing roller which accelerates the cooling of the welded seam in the panel 6. Additional cooling of the weld, e.g. by means of a current of air, could also be provided at the end of the welding machine 3, or between the welding machine and the smoothing unit 2, or in or after the smoothing unit 2. In any case, even if the panel 6 passes directly from the welding machine 3 into the cooling unit 1 after traversing a short distance on the conveyor, there is a much shorter cooling process than in conventional known methods, in which oiling of the sheet is deferred for at least 3–5 minutes until the sheet has cooled to a temperature of 100° C. or below. According to the invention, the compound panel 6 is treated in the cobling unit 1 with a fluid which causes rapid cooling of the welded seam of the panel 6. For this purpose, in the illustrated example, a tank 8 containing a relatively large quantity of the fluid 9 is provided. The fluid in question is preferably standard rust-preventative oil as used after the normal extended cooling phase. An oil/water emulsion, likewise of a known and commercially available type, could also be used instead of the rust-preventative oil.

In the illustrated example the fluid 9 is pumped by means of a pump 10 through a filter 11 into two feed lines 12 and 13. The feed lines 12 and 13 discharge the fluid on to the welded seam of the compound panel 6, which is conveyed by the conveyor 5 through a spray enclosure 15, 16 in which the fluid strikes the welded seam. The two halves 15, 16 of the spray enclosure are sealed off from the conveyor 5 by brush screens 4 which allow the compound panel 6 to pass into the region of the spray enclosure and which as far as possible prevent the oil sprayed on to the weld inside the spray enclosure from escaping from the spray enclosure. Any fluid which does escape is collected in a trough 7 and is returned to the tank via an outlet 20. Excess oil inside the spray enclosure 15, 16 is returned to the tank 8 on the one hand via an outlet 19 and on the other hand via an oil and fume extraction system with a pump 17 discharging via a line 18. The fluid squirted or sprayed on to the hot weld from both sides inside the spray enclosure causes the hot weld to cool rapidly to a temperature of below 100°, at which vaporization of the fluid usually no longer occurs. On leaving the unit 1, the sheet is therefore cooled and oiled and is ready for further use, or for interim storage. A further brushing station may be located after the cooling unit 1 to enable the welded seam to undergo further cleaning with a relatively soft brush.

The fluid 9 in the tank 8 may be cooled by a cooler. Alternatively the quantity of fluid 9 may be sufficiently large for adequate cooling to be provided by radiation from the tank. The squirting or spraying of fluid on to the welded seam of the panel 6 produces a certain cleaning effect on the welded seam. For this reason, it is preferable to pump the fluid through a filter 11 to catch impurities.

Cooling with the fluid, which is applied to the weld when the latter is at a temperature well above the vaporization temperature of the fluid, results in a decrease in the temperature of the weld which is very rapid and hence occurs over a short conveyor path. Fluid vapour, and possibly fumes, which are given off are extracted and fed back to the fluid tank within the unit 1. The unit 1 is therefore totally enclosed, and allows a newly welded compound panel 6 to be inserted at one end and an oiled and cooled panel to be removed at the other end. Compared with conventional extended cooling paths (or even intermediate cooling storage stations), the unit takes up little space. Since the onset of cooling by the fluid does not occur until the temperature has fallen to a relatively low level in the region of 150°–300°, the rapid quenching of the weld does not cause embrittlement or hardening of the weld.

Figure 2:
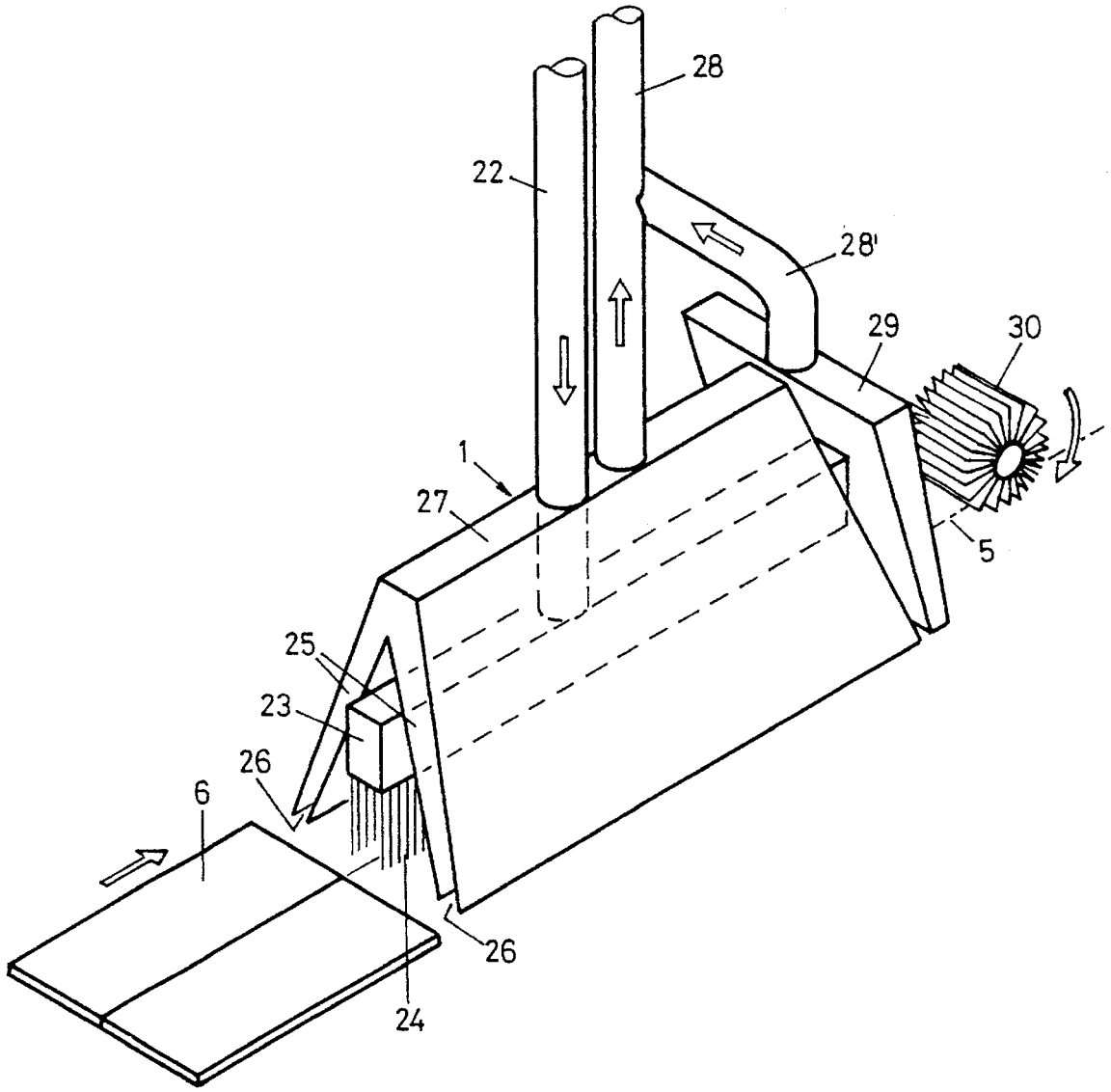
FIG. 2, which is also schematic only, shows a view of a preferred embodiment of a further device for carrying out the process.

FIG. 2 shows a further embodiment of the unit 1. Only that part of the unit 1 which is above the panel 6 and the conveyor 5 is illustrated, that part which is preferably also provided underneath the panel 6 being omitted from the figure. Also not shown in FIG. 2 are the fluid tank 8, the pump 10 and the filter 11. The figure shows an oil feed, supplied from the fluid tank, which opens above the panel 6 into a distributor element 23 which distributes the fluid feed in the longitudinal direction of the seam. The fluid is discharged along the whole length of the distributor element 23 e.g. between the bristles of a brush 24, on to the welded seam of the compound panel 6. On either side of the welded seam, fluid collector elements 25 are arranged, each possessing a suction slit which extends parallel with the welded seam and which is in contact with, or positioned close to, the panel. From a central collector duct 27 the fluid passes into a fluid return line 28 leading back to the tank. A wiper and suction element 29 is arranged at right angles to the conveying direction of the panel, at the end (in the conveying direction) of the applicator element 23. This element 29 is provided with at least one suction slit in contact with, or positioned close to, the panel. From it, a line 28' also leads back to the tank. A brush 30 may be provided after the element 29 for posttreatment of the weld. Similar elements to those shown above the panel 6 in FIG. 2 are preferably arranged underneath the panel.

Figure 3:
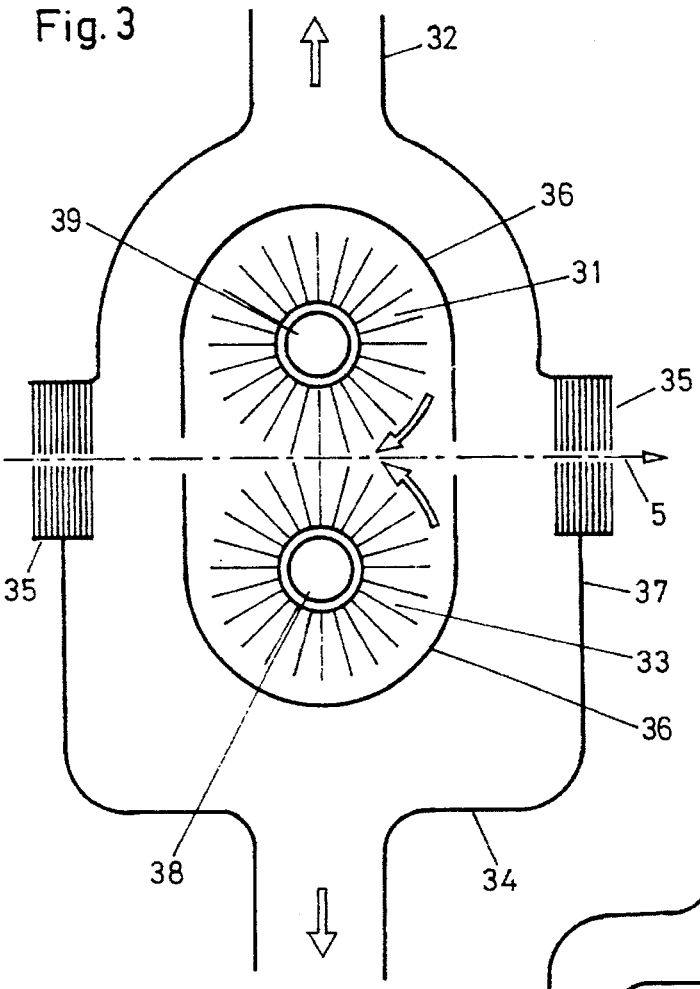
FIG. 3 shows a further embodiment of a device in vertical section.

FIG. 3 shows a further view of a cooling device 1, in which the compound panel on the conveyor 5 enters the unit through brush screens 35 and then passes between two rotating brushes 31 and 33. The fluid feed, which is not shown in detail in FIG. 3, is from the centre 39 and 38, respectively, of these brushes. Here again fluid is pumped from a tank via feed lines to the centres of the brushes 31 and 33. In this way, the fluid is applied to the weld seam as before, and is additionally spread over the weld seam by the contrarotating brushes. A splash guard 36 ensures that the fluid remains essentially contained within the brushing zone. A lower sump 34 conveys the excess fluid back to the tank. An upper extraction hood 32 again conveys fluid, fluid vapour and fluid fumes back via a pump to the tank. The oiled and brushed sheets exit from the unit 1 through another brush screen 35 on the conveyor 5.

Figure 4:
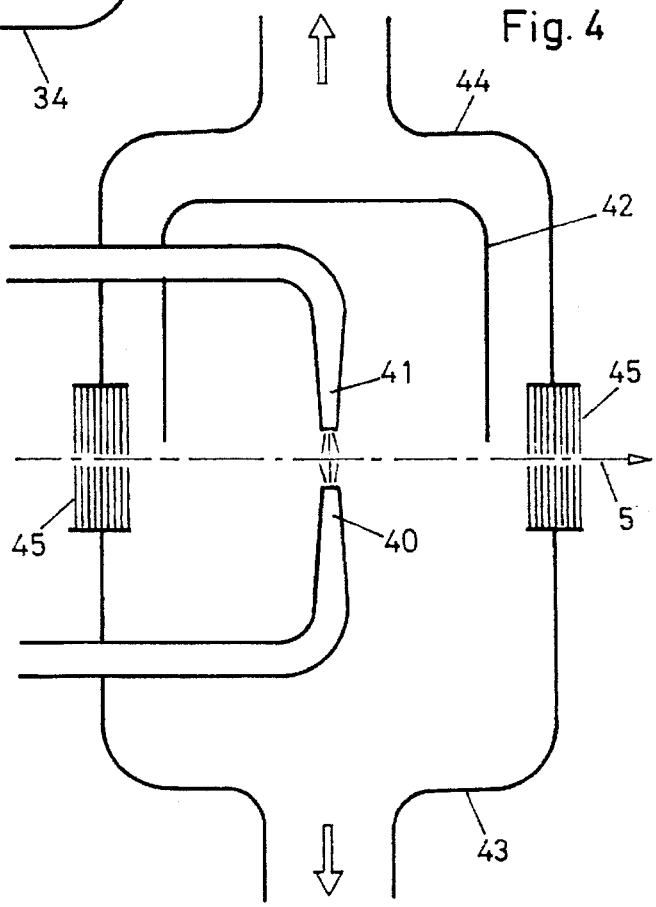
FIG. 4 likewise shows an embodiment of a device in vertical section.

FIG. 4 shows a further embodiment of the unit 1, which is provided with flat spray nozzles 41 and 40 which spray the weld in the panel 6 conveyed into the unit 1 on the conveyor 5. The panel enters and exits through brush screens 45. A splash guard 42 is arranged above the nozzle 41. A sump 43 with an outlet leading into the tank returns excess fluid to the tank. A similar function is performed by an extraction hood 44, which also returns fluid vapour and fumes to the tank.

A smoothing and brushing unit 2 can also be provided between the welding machine and the unit 1 in each of the devices shown in FIGS. 2 to 4. Similarly, a brushing station with one or more brushes for cleaning the sheets can also be provided after the plate exits from the brush screen 35 or 45. Similarly, an additional oiling station can, if required, be arranged after the cooling unit 1, for application of additional rust-preventative oil to the sheet after the latter has fully cooled. Such an additional oiling station should be provided especially if the fluid used is not a liquid like the said rust-preventative oil, but a gas or a gas/liquid mixture (which is also theoretically possible).

I claim:

1. Process for the formation and posttreatment of welded compound panels comprising the steps of:

welding respective edges of steel sheets along a common welding seam in a welding station to form compound panels, the weld seam being heated to a temperature in excess of about 1500° C. during welding;

conveying the compound sheets after welding to a fluid applying station;

applying a rust preventative fluid along the weld seam, the step of applying being performed at the fluid applying station beginning when the weld seam temperature is between about 300° C. to 150° C. and ending when the weld seam temperature is about 100° C.; and removing excess fluid from and leaving a fluid film on the weld seam.

2. Process according to claim 1, characterized in that the fluid is applied at a weld seam temperature which is higher than the vaporization temperature of the fluid.

3. Process according to claim 1, characterized in that the fluid application step commences at a weld seam temperature which is approximately 1.5 to 3 times the vaporization temperature.

4. Process according to claim 1, characterized in that the fluid application step commences approximately 5 to 30 seconds after welding.

5. Process according to claim 1, wherein the weld zone is cooled on one or both sides of the compound panel.

6. Process according to claim 1, wherein the application of fluid is applied in such a way that vaporization has essentially ceased when the welded seam leaves the application zone.

7. Process according to claim 1, wherein prior to the application of fluid, a step of mechanical treating of the weld seam is performed to remove at least coarse contamination of the weld seam.

8. Process according to claim 1, wherein a cleaning treatment step is performed during or after the fluid application.

9. Process according to claim 1, wherein the step of welding is performed by roller seam welding or laser welding.

10. Process according to claim 1, further comprising the step of precooling the weld seam to the fluid application temperature directly after welding.

11. Process according to claim 10, wherein the step of precooling is effected by a cooled smoothing roller for smoothing the weld seam.

12. Process according to claim 10, wherein the step of precooling is effected by blowing the weld seam with a cooling gas.

13. Device for the formation and posttreatment of welded compound panels comprising:

a welding station for welding respective edges of steel sheets along a common weld seam to form compound panels, the weld seam being heated to a temperature of about 1500° C. during welding;

means for conveying compound panels from the welding station in a conveying direction; and a fluid application unit which is located after the welding station in the conveying direction, the fluid application unit including means for applying a rust-preventing fluid to the weld seam of a compound panel when the weld seam temperature is between about 150° C.–300° C., a fluid feed tank for supplying the fluid applying means, an enclosure for enclosing the fluid applying means and the compound panels to which the fluid is being applied, and means for collecting excess fluid and fluid vapors from the enclosure from the application of fluid to the weld seam and for feeding collected fluid and vapors back into the supply tank.

14. Device according to claim 13, wherein the fluid applying means applies fluid to the weld seam using at least one rotating brush.

15. Device according to claim 13, characterized in that the fluid application unit applies fluid to the weld seam via spray elements.

16. Device according to claim 13, wherein the fluid applying means applies fluid to the weld seam using at least one stationary brush.

17. Device according to claim 13, characterized in that the fluid application unit has a distributor element extending in the direction of the weld seam.

18. Device according to claim 17, characterized in that the means of collecting comprises suction elements provided on either side of the distributor element, and a further suction element provided at the end of the distributor element.

19. Device according to claim 18, characterized in that a brush is arranged after the further suction element.

20. Process for the formation and posttreatment of welded compound panels, comprising the steps of:

welding respective edges of steel sheets along a common weld seam to form compound panels;

mechanically treating the weld seams to remove at least coarse contamination of the weld seam; and applying a rust-preventing fluid to the weld seam for cooling the weld seam.

21. Device for the formation and posttreatment of welded compound panels, comprising:

a welding machine for welding respective edges of steel sheets along a common weld seam to form compound panels;

a conveyor for conveying the compound panels from the welding machine in a conveying direction;

a rust-preventing fluid application unit located after the welding machine in a conveying direction, the fluid application unit being supplied from a fluid feed tank and having a fluid distribution element oriented parallel to the orientation of the weld seams, suction elements positioned on either side of the distribution element and a further suction element positioned at one end of the distribution element, each suction element for removing excess fluid from the weld seams, and a brush located after the further suction element in the conveying direction.

* * * * *